United States Patent [19]

Zimmerman

[11] 4,181,056

[45] Jan. 1, 1980

[54] DOUBLE BAY WOODWORKING MACHINE

[76] Inventor: Edwin H. Zimmerman, R.D. #1, New Holland, Pa. 17557

[21] Appl. No.: 936,338

[22] Filed: Aug. 24, 1978

[51] Int. Cl.[2] ..... B27C 9/04

[52] U.S. Cl. ..... 83/360; 83/422; 83/425.4; 83/436; 144/41; 144/312

[58] Field of Search ..... 144/312, 39, 41; 83/425.3, 425.4, 422, 360, 367, 436

[56] References Cited

U.S. PATENT DOCUMENTS

| | | | |
|---|---|---|---|
| 387,604 | 8/1888 | St. Louis | 83/425.3 X |
| 2,505,235 | 4/1950 | Derbenwick et al. | 83/425.3 |
| 2,597,279 | 5/1952 | Bailey | 83/425.3 |
| 4,009,741 | 3/1977 | Zimmerman | 144/41 |

*Primary Examiner*—Meister, J. M.
*Attorney, Agent, or Firm*—C. Hercus Just

[57] ABSTRACT

A double bay industrial saw having delivery mechanism to receive timber cants of substantial size selectively directed to either saw bay where a single source of power operates multiple saw systems respectively operable to produce different types of boards with different edge configurations simultaneously as selected and desired. The cantilever type of pairs of arbors at opposite sides of a central housing respectively support sets of cooperating saw blades on driven arbors separately driven and supported upon separate arbors, and chippers if required to form edge configurations are also mounted upon said arbors, whereby the saws produce finished cuts in the cants to form completed products at the delivery end of the machine. Various feed rollers and cooperating pressure rollers insure positive feeding of the cants to and through the sawing regions of the machine.

12 Claims, 9 Drawing Figures

DOUBLE BAY WOODWORKING MACHINE

BACKGROUND OF THE INVENTION

In certain respects, the present invention comprises an improvement over applicant's prior U.S. Pat. No. 4,009,741, issued Mar. 1, 1977, entitled "WOODWORKING MACHINE". Said machine is capable of sawing large dimension timbers in the form of large beams or planks, especially substantially square timbers which are known in the woodworking trade as cants. By way of example without limitation to the application of the invention, the woodworking machine of the present invention is capable of sawing timbers or cants as large as ten inches square by the use of circular saw blades fourteen inches in diameter. By a single pass of such cants through the machine, finished boards are produced from cants of that size.

It is conceivable, of course, that by using saw blades of larger diameters, cants of even greater size than that specified may be handled by the machine to produce finished boards.

Applicant's prior patent discloses a double arbor sawing machine in which separate sets of cooperating saw blades are mounted respectively upon said arbors and the blades engage the timber or cant respectively to saw upper and lower parts of a single cut extending entirely through the cant from top to bottom. A plurality of such saws are mounted in axially spaced relationship upon the arbors so as to produce a number of boards simultaneously for purposes of consuming substantially the entire timber or cant and convert it to finished products in which the opposite surfaces of the boards are finished when appropriate saw blades are used and, in addition, edge configurations can be formed by the use of appropriately shaped chippers positioned between the plurality of saw blades, all of which is fully described in said prior patent.

Woodworking machines of the type shown and claimed in applicant's aforementioned prior patent normally are employed in the lumbering industry in which it is convenient to use as driving means diesel engines of relatively high horsepower capacity and, under some circumstances, a single diesel engine is employed not only to drive the aforementioned woodworking machine, but, in addition, also drive other related machines, such as timber unscrambling devices which sort and deliver the timbers or cants successively to the sawing machine, as well as succeeding machines which perform additional operations, for example upon the finished board, such as sawing them to suitable length, stacking them, and otherwise.

In accordance with the present invention, it has been found from experimentation that substantially no additional power is required to operate a machine of the type embodying the principles of the present invention in which a plurality of bays are included respectively to receive, either successively or simultaneously, timbers or cants which are sawed by the machine in which pairs of arbors extend from opposite sides of a central housing which is disposed between feed paths that are parallel to each other and coextensive in length, thereby substantially increasing the capacity of the machine to produce finished products, details of which are described hereinafter.

In addition to substantially no increase in power being required, it has been found that an increase in production of at least 30% or more is possible which, when considered in conjunction with only approximately the same power needs being required, much greater economies are effected than when employing a machine of the type shown in applicant's aforementioned patent. Uniformity of product also has been found to be improved. However, in providing for such double operation, certain novel construction features had to be devised, not only in the saw portion of the woodworking system of the invention but also in the means to feed the timbers or cants to the sawing machine, details of which are set forth hereinafter and are fully described in the specification and included in the claims, as well as being illustrated in the drawings of the application.

At first glance, it might be considered that merely providing two sets of saws instead of one, is a rather obvious way of increasing the production of a sawing operation. For example, in the prior art, the relatively old U.S. Pat. No. 387,604, to St. Louis, dated Aug. 7, 1888, shows a single arbor, the opposite ends of which extend beyond bearings between which a drive pulley is mounted, a pair of saws respectively being mounted on the opposite ends of said arbor, the saws being operated simultaneously to produce a plurality of cuts transversely in the trimming of the ends of boards moved past the saws. In another embodiment of said patent, more than two saws are employed for purposes of making simultaneously transverse cuts in boards.

Also, purely from the standpoint of making pluralities of cuts in individual products, the food machinery industry includes illustrations of pluralities of circular knives operable respectively upon certain food objects to sever the same simultaneously and examples of such devices are shown in prior U.S. Pat. Nos. 2,505,235 to Derbenwick et al, dated Apr. 25, 1950, and 2,597,279 to Bailey, dated May 20, 1952, in which apples and almonds respectively are cut in half while feeding rows of the same respectively to the rotary knife. None of these machines, however, suggest the additional mechanisms required to increase the capacity of timber-sawing machines both in regard to the actual sawing operation, as well as the feeding of the timbers or cants to the sawing mechanism and the present invention supplies the required details and innovations to effect the increase in production referred broadly hereinabove, details of all of said mechanism being set forth below.

SUMMARY OF THE INVENTION

It is one of the principal objects of the present invention to provide a double bay industrial type saw unit, employing a central housing between two parallel feed paths which respectively are adapted to receive and propel timbers or cants, especially timbers or cants of large dimension, either simultaneously or successively along said paths by which the timbers or cants are fed to and moved past cooperating saw blades and/or chippers, which respectively engage the timbers or cants from above and below, not only to provide finished surfaces on opposite sides of the boards produced by the sawing operation, but also effect desired edges upon the boards, another important feature of the arrangement being that different widths of boards may be produced respectively by the sawing units on opposite sides of the housing, but different edge configurations likewise may be formed upon the boards respectively formed by said sawing units.

Another important object of the invention is to provide adequate feed means respectively for said feed paths which engage the lower surfaces of the beams or cants and positively feed the same to, past and beyond the saws on the respective arbors at opposite sides of the housing, and in which said arbors are spaced both longitudinally and vertically, substantially along a diagonal line extending at an acute angle to said paths, whereby the saws respectively engage the upper and lower portions of the cants to effect complete cuts, said feeding means comprising pluralities of similar rollers mounted on horizontal shafts which are positively driven in similar directions, the rollers engaging the cants in a frictional manner, such as by utilizing axially extending relatively sharp ridges on the surface of the rollers and, even more importantly, by providing adequate pressure rollers engaging the upper surfaces of the cants, said rollers being of an idler type but, nevertheless, being positively forced downwardly against the upper surfaces of the cant, there preferably being a pair of such rollers fore and aft of the sawing unit and one roller of each pair being positively urged forcefully downward by a fluid-operated cylinder unit and the second roller of each pair being urged by means having pressure relief in the form of springs.

A further important object of the invention anxillary to the foregoing object is to provide sub-frame means within the central housing which supports shafts upon which the upper pressure rollers are mounted by means of crank arms, bearings in the sides of said central housing also assisting in the support of said shafts and the shafts for the pressure rollers respectively above the opposite feed paths being coaxial but separate from each other and the shafts of one pair thereof respectively being powered by said aforementioned fluid-operated units, while the other pair of shafts are acted upon by said spring means referred to above so as to provide limited relief for the pressure rollers supported by said second shafts.

Still another very important object of the invention is to provide adjacent the receiving end of the saw system, additional feed rollers and pressure rollers respectively engageable with opposite sides of the cants as the same are delivered to the saw system, said feed and pressure rollers coacting as pairs and the feed rollers each being mounted on vertical shafts driven by power means and positioned to engage the side surfaces of the cants which are nearest the central axis of the saw system; the drive shafts for said feed rollers being vertical and simultaneously driven by a transverse drive shaft through the medium of bevel gears on opposite ends thereof and the lower ends of the drive shafts for the feed rollers, while the pressure rollers are mounted on pivoted arms actuated by crank arms on one end of the pivoted arms and the outer ends of the pivoted arms supporting on vertical shafts, the aforementioned pressure rollers which are of an idler nature, but are urged against the outer surfaces of the cants by fluid-operated cylinder units connected to said crank arms.

Ancillary to the foregoing object, it is still another very important object of the present invention to actuate the fluid-operated cylinder unit of both the pressure rollers adjacent the inlet of the saw system, as well as the pressure rollers engaging the upper surfaces of the cant while moving along the respective feed paths at opposite sides of the central housing by means of micro switches controlling valves in fluid-conducting conduits communicating with said cylinder unit, said micro switches being actuated by yieldable pivoted arms engaged by the leading ends of the cants and continuing to be engaged by the lower and one side surface of each cant until the cants pass said yieldable means, whereby the fluid-operated units only exert pressure upon the pressure rollers while necessary to engage the respective surfaces of the cants.

Another important object of the invention is to provide heavy-duty means to feed cants respectively to the receiving ends of the feed paths of the saw system, said feeding mechanism comprising a plurality of preferably chain-type conveyors which extend transversely from one side of the longitudinal axis of the saw system, one end of the upper spans of said endless conveyors being adjacent an extension of the central axis of the saw system beyond the receiving end thereof and the opposite ends of said upper spans being spaced laterally a substantial distance away from the central axis of the saw system so as to receive cants individually and successively as moved onto the conveyor chains, either manually or by power means, the feed means also including longitudinally extending stationary fence members defining the movement limit of the cants, said limit being in alignment with the feed path farthest from the outer ends of said conveyor chain, whereby when cants are to be delivered to said so-called farthest feed path, the delivery movement thereof by the chains will be stopped and a plurality of arm frames which are pivotally mounted at one end on a lower longitudinal frame projecting outward from the saw system in axial alignment therewith and the upper ends of said arm frames support at opposite sides thereof, a pair of feed rollers which are constantly driven and, when a cant abuts, for example, said fence members, said arms are pivotally moved to elevate the feed rollers at one side of each of said arms into engagement with the lower surface of the cant disposed against said fence member and are operable to advance the same to said farthest feed path of the saw system for engagement by the feed and pressure rollers adjacent the receiving end of said path. Ancillary to the foregoing object, it is a further object of the invention to provide means whereby, when a cant is to be delivered to the so-called near feed path, which is the opposite one from said farthest feed path referred to above, instead of permitting the conveyor chains to advance the cant into engagement with the fence means, the arm frames are actuated to elevate the outer ends thereof which extend beyond the feed rollers to a position to obstruct further feeding movement of a cant, and thereby dispose the feed rollers at the near side of said arm frame into engagement with the lower surface of the cant and move the same toward the saw system for reception by the so-called near feed path for engagement of the cant by the feed and pressure rollers adjacent the receiving end of said near path of the saw system.

Still another object of the invention ancillary to the foregoing objects is to provide an additional fluid-operated cylinder unit mounted centrally of said lower frame of the delivery and feeding system described above, the piston thereof being elongated and each of said plurality of arm frames having the equivalent of crank arms extending from and connected to supporting shafts which are fixed to said arm frames, and short links are commonly connected respectively to outer ends of said crank arms and said piston rod, thereby to simultaneously raise and lower all of said arm frames and the feed rollers supported thereby adjacent the upper ends thereof.

One further object of the invention in regard to the power means for the saw system and feed means is to provide preferably separate electric motors to drive the arbors of the saw system upon which the saws and/or chippers are mounted, said arbors being unitary for the full length thereof and the opposite end of said arbors respectively extending beyond the opposite sides of the central housing, but in regard to all other power requirements for the various feed rollers and pressure rollers in both the saw system and feed means, including those on the pivotally mounted arm frames in the feed mechanism, and the conveyor chains of said feed mechanism, only a single source of power is employed, such as a relatively high-powered diesel engine mounted in a suitable location with respect to the saw system. Details of the foregoing objects and of the invention, as well as other objects thereof, are set forth in the following specification and illustrated in the accompanying drawings comprising a part thereof.

DETAILED DESCRIPTION OF THE PREFERRED EMBODIMENTS

Figure 1:
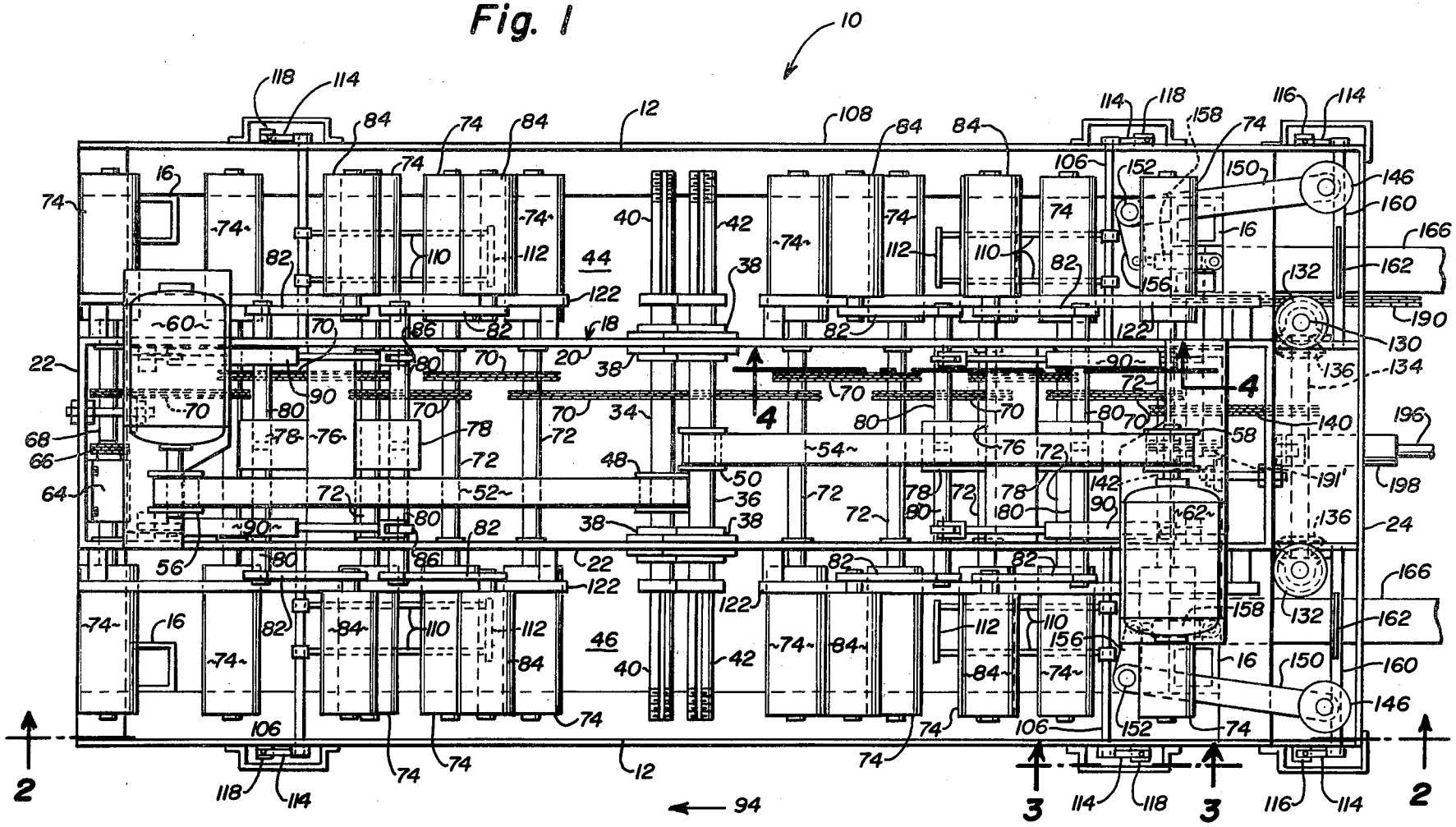
FIG. 1 is a top plan view of the details of the saw system per se, certain portions of the feed mechanism being fragmentarily illustrated adjacent the right-hand end thereof.
Figure 2:
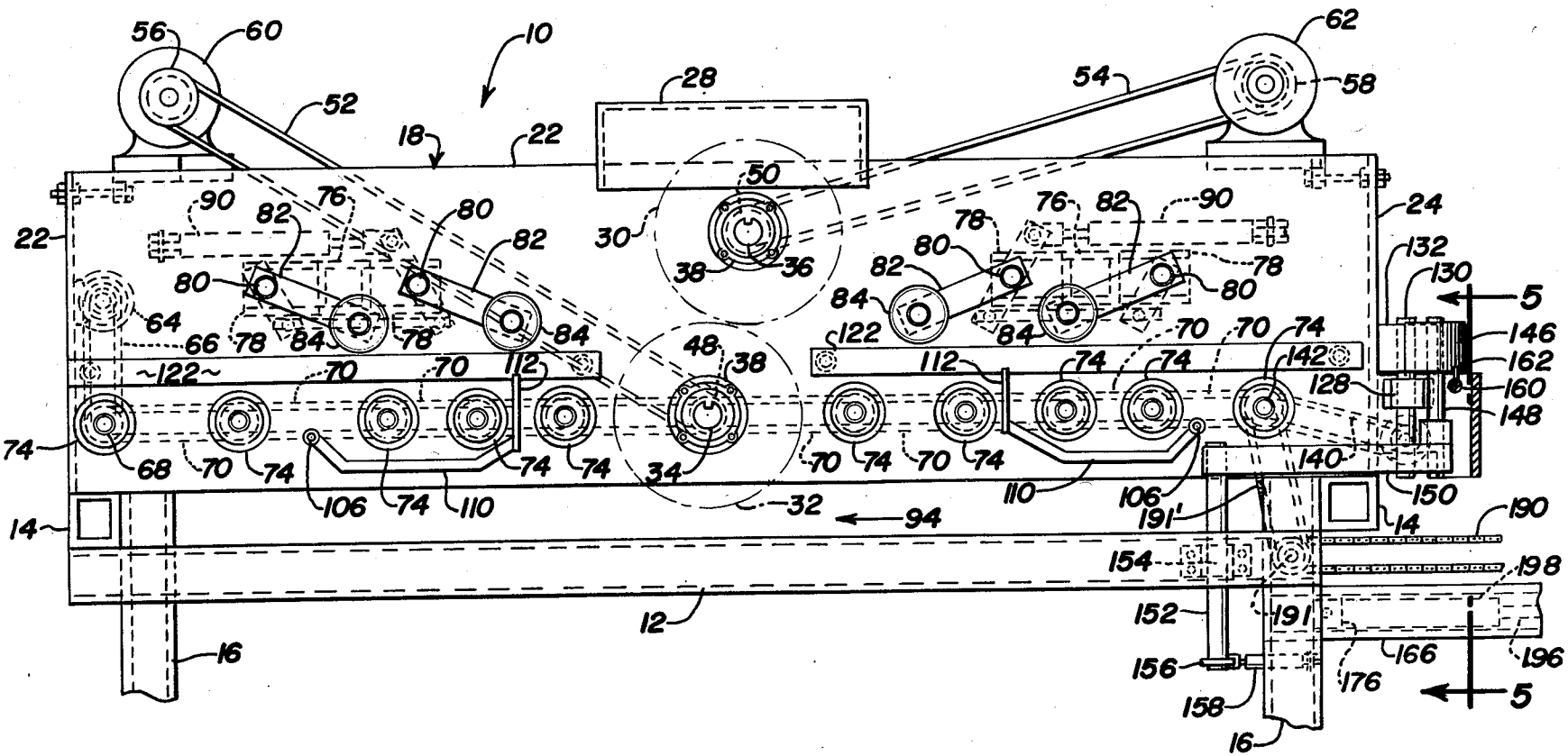
FIG. 2 is a side elevation of the saw system illustrated in FIG. 1 and, correspondingly, a fragmentary portion of the feed mechanism being illustrated adjacent the right-hand end thereof, as seen on the line 2—2 of FIG. 1.
Figure 6:
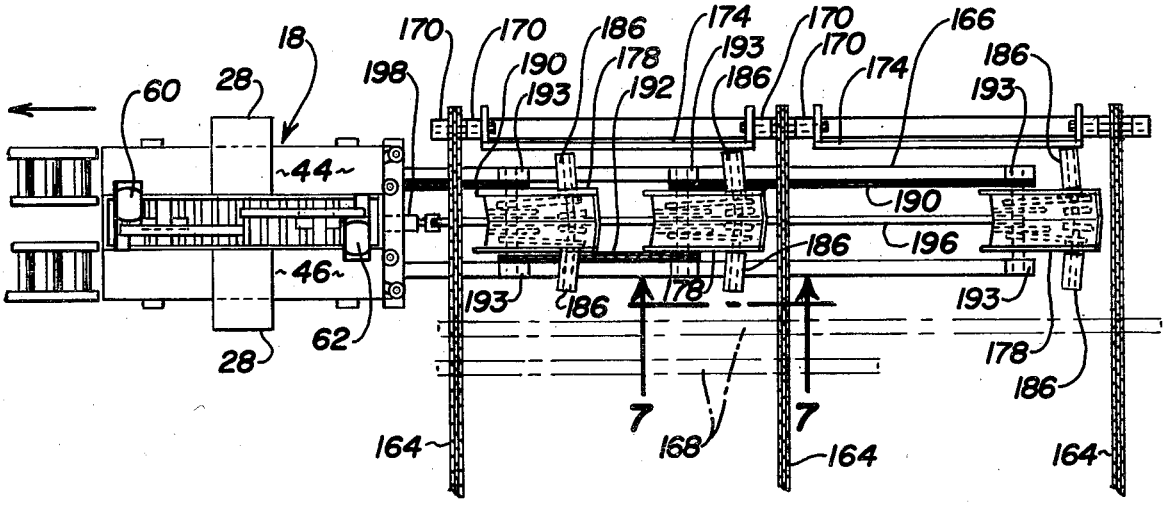
FIG. 6 is a fragmentary plan view showing the portion of the feed mechanism nearest the longitudinal axis of the saw system extending from the receiving end thereof.

Referring particularly to FIGS. 1 and 2, the double bay saw system is shown respectively in plan and side elevation, whereas in FIG. 6, the feed mechanism which receives and moves timbers and cants to the receiving end of the saw system is shown on a smaller scale in plan view. The saw system 10 comprises a longitudinal frame which includes side members 12, which are parallel to each other, and end members 14, which extend transversely between the opposite ends of the side members 12. Said frame members are in the lower portion of the machine which, preferably, is supported at the corners by short legs 16, fragmentarily shown in FIG. 2. Supported centrally of said frame is a longitudinal, rectangular housing 18, which is composed of planar side members which are plates of steel that are parallel to each other and of similar size, the lower edges thereof being directly supported upon the end members 14, as best shown in FIG. 2. The housing 18 also includes end cover plates 24 and 26, securely affixed to the ends of the side members 20 and 22. As shown in FIG. 2, there also is a central cap member 28, which covers the uppermost saw unit 30, shown in phantom in FIG. 2, and the lower saw unit 32 also being shown in phantom in said figure.

The cap member 28 also directs sawdust and/or chips downwardly through the machine for discharge through the bottom of the frame.

Extending transversely between and through the side members 20 and 22 of housing 18 are a pair of unitary arbors 34 and 36, comprising steel shafts of the same diameter and supported within appropriate bearings 38, mounted respectively within the side members 20 and 22. The projecting opposite ends are of appreciable length adequate to support individually a plurality of sets of circular blades and either spacers or chippers interspersed therebetween for purposes of sawing a plurality of boards simultaneously from timbers or cants of appreciable diameters, such as the order of as much as ten inches square or otherwise, said indication being for purposes of illustration, rather than limitation. Said projecting ends 40 and 42 of the arbors 34 and 36 extend at the outer ends thereof beyond the outer edges of the feed paths 44 and 46, which are shown in plan view in FIG. 1, in order that securing nuts and locknuts, not shown, may be threaded onto the terminal end of said outer ends 40 and 42 of the arbors 34 and 36.

Mounted upon the arbors 34 and 36 within the confines of the housing 18, as shown in FIG. 1, are driven pulleys 48 and 50, around which drive belts 52 and 54 extend, said belts also extending around drive pulleys 56 and 58 respectively mounted upon the drive shafts of electric motors 60 and 62, which are of substantial horsepower, due to the fact that particularly when gangs or sets of as many as possibly ten, twelve, or more circular saw blades and chippers are mounted upon the outer ends 40 and 42 of the arbor, are all simultaneously forming saw cuts and/or end configurations on boards being simultaneously produced from single timbers or cants, such appreciable power is necessary, Also, in FIG. 2, it will be seen that the arbors 34 and 36 are spaced apart vertically a substantial distance, and also the same are spaced longitudinally apart a limited distance in order that saw blades which preferably are of the same diameter may cooperate respectively to saw parts of a complete cut made vertically within the timber or cant while making one pass through the saw system, as described in greater detail in applicant's prior U.S. Pat. No. 4,009,741. Further, it is preferred that the circular saw blades be of special type, such as carbide tipped and slightly hollow ground blades, in order that finished surfaces may be formed on the opposite sides of boards produced by the operation, in addition to the edges thereof likewise being finished by appropriate chippers of suitable shape, for example, whereby tongue and groove, shiplap, or other configurations may be formed, depending upon the peripheral shape of the chippers. The blades and chippers are also keyed to the arbors to insure positive drive thereof.

Intermediate power means comprising a hydraulic motor 64 has a sprocket gear on the drive shaft thereof which drives a vertically extending sprocket chain 66 which extends around a similar sprocket gear on driven shaft 68, which extends between side members 20 and 22. The driven shaft 68 is connected by a series of sprocket chains 70 to a plurality of transverse shafts 72, which extend through and are supported by bearings in the side members 20 and 22 of housing 18, the outer ends of said shafts being substantially coextensive in length with the outer ends 40 and 42 of arbors 34 and 36 for purposes of supporting a plurality of similar lower feed rollers 74 which are best shown in FIG. 2, the upper surfaces of which are all within a common plane and respectively define a farther and nearer feed path 44 and 46 for the cants which are driven to, past and beyond the upper and lower saw units 30 and 32. The hydraulic motor 64 is driven by fluid under pressure from a suitable pump driven by the main power source of the saw and feed system, such as the aforementioned diesel motor of substantial horsepower, said pump and diesel motor not being illustrated. During the operation of the machine, the lower feed rollers 74 are driven continuously by said power means.

For purposes of applying pressure to the upper surfaces of the cants as they are driven past the saw units by the bottom drive rollers 74, the present invention includes sub-frames which are mounted within and extend between the side members 20 and 22, said sub-frames comprising transverse square tubular members 76, the ends of which are suitably affixed, such as by welding, to the inner surfaces of the side members 20 and 22 and extending longitudinally of the housing 18 from opposite sides of the members 76, intermediately of the ends thereof, are extensions 78 provided with suitable bearings within which one end of pairs of short shafts 80 are mounted for limited rotation, said shafts also extending through corresponding bearings in side members 20 and 22, whereby the outer ends of said short shafts project limited distances beyond the outer surfaces respectively of side members 20 and 22, the terminal ends thereof respectively being connected to crank arms 82. Projecting outward respectively in opposite transverse direction from the crank arms 82 at opposite sides of the housing 18, are additional horizontal shafts which support upper pressure rollers 84 which are substantially similar in length and diameter to the feed rollers 74.

Figure 4:
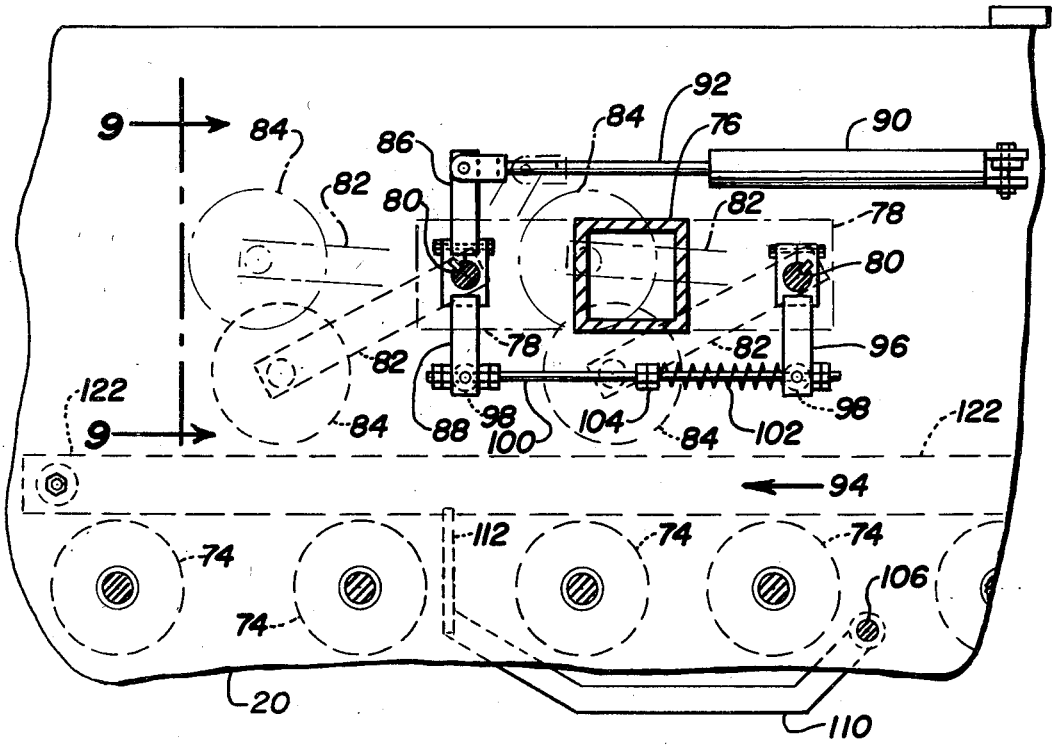
FIG. 4 is an enlarged fragmentary vertical sectioned elevation of details of the mechanism for activating the upper pressure rollers of the saw system as seen on the line 4—4 of FIG. 1.

Referring particularly to FIG. 4, wherein the upper pressure rollers and the means supporting and activating the same are more clearly illustrated than in FIGS. 1 and 2, especially since a larger scale is employed, it will be seen that additional crank arms 86 are keyed at one end to the short shafts 80 supported by one of the extensions 78, and one end of a yoke 88 is also keyed to the same short shaft 80, said additional crank arms 86 and yokes 88 being keyed to said short shafts 80 at opposite sides of the extensions 78 on transverse members 76, which comprise sub-frame assemblies.

In view of the fact that the crank arms 82 which are likewise keyed to the last-mentioned short shafts 80 at opposite sides of the extensions 78, actuation of the crank arms 86 on each of said shafts 80, will move the crank arms 82 and yoke 88 affixed thereto in the same rotary direction as driven, for example, by the fluid-operated cylinder unit 90, which, preferably, is hydraulically operated. The piston 92 of said unit is pivotally connected to the upper end of the crank arm 86 and when the unit 90 is energized by means described hereinafter, to extend the piston rod 92 thereof, the arm 82 adjacent the left end of FIG. 4, will be rotated counterclockwise so as to depress the pressure rollers 84 thereon, and force the same against the upper surface of a cant being moved longitudinally in feeding direction through the machine by feed rollers 74, as indicated by the directional arrow 94 in said figure, thereby insuring firm frictional engagement of the feed rollers 74 with the lower surface of said cant.

Figure 9:
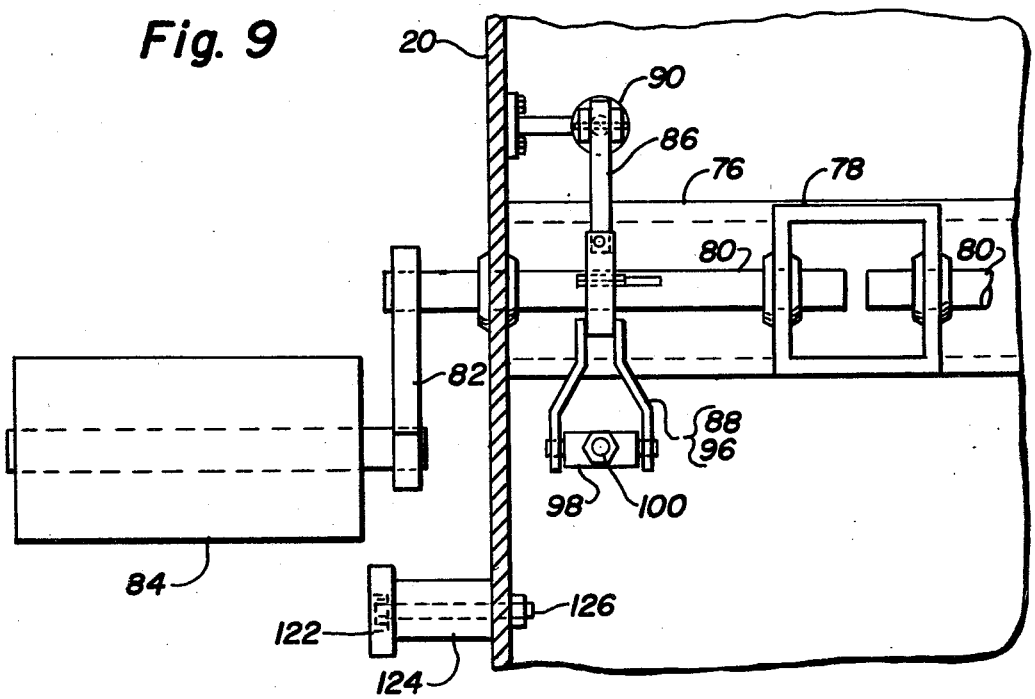
FIG. 9 is an enlarged fragmentary vertical section of the mounting and operating mechanism for the upper pressure rollers, as seen on the line 9—9 of FIG. 4.

To furnish additional pressure upon the upper surface of such cant, it will be seen that the crank arms 82 connected to the short shafts 80 adjacent the right-hand end of FIG. 4, has an additional yoke 96 keyed thereto and the arms of the yokes 88 and 96, as seen in FIG. 9, respectively have a transverse support 98 pivotally connected to the arms of said yokes, said supports being apertured to receive therebetween the opposite ends of a horizontal rod 100 around which a compression spring 102 extends for part of the length of the rod 100, said spring extending between a fixed abutment 104 on rod 100, and transverse support 98 on yoke 96.

As will be seen especially from FIG. 4, the yokes 88 and 96 preferably are parallel to each other and the arms 82 respectively on each of the short shafts 80 also project in planes which are parallel to each other and at acute angles with respect to the yokes 88 and 96. The end of the rod 100 which is connected to the transverse support 98 of yoke 88 is adjustable with respect to said transverse support by means of nuts and locknuts, clearly shown in FIG. 4, in order to adjust the yokes 88 and 96 to be parallel to each other. Similarly, the fixed abutment 104 may be adjusted, as desired, upon rod 100 in order to produce the desired amount of compression in spring 102 incident to maintaining the desired amount of pressure upon the roller 84 which is maintained under pressure by the spring 102. Also, in view of the arrangement just described, movement of the piston rod 92 in opposite directions by the cylinder unit 90 will simultaneously move both of the upper pressure rollers 84 in corresponding direction toward or from a cant engaged thereby.

Figure 3:
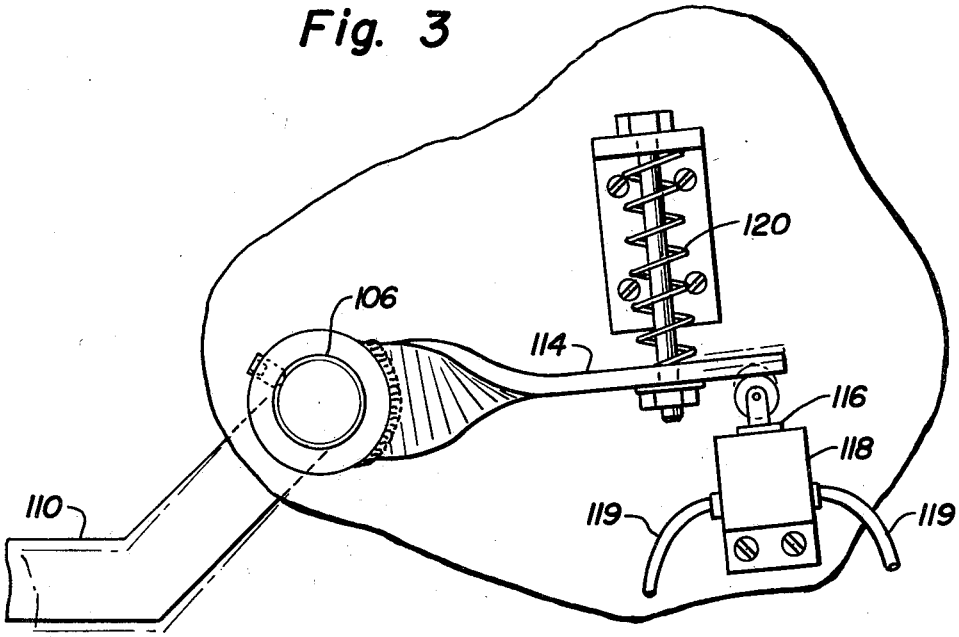
FIG. 3 is an enlarged fragmentary side elevation taken on the line 3—3 of FIG. 1, and illustrating details of the control mechanism for the fluid cylinder unit for the pressure rollers of the saw system.

Positive movement of the upper pressure rollers 84 upon the upper surface of a cant is effected by control means illustrated in enlarged manner fragmentarily in FIG. 3. Said control means comprise transverse shafts 106, shown respectively in FIGS. 1 and 2 adjacent opposite sides and opposite ends of the saw system shown therein, said shafts being suitably pivotally supported on fixed axes with respect to side members 20 and 22 and additional supplemental outer plates 108, shown in FIG. 1. Pairs of irregularly-shaped arms 110 extend substantially horizontally therefrom in normal condition, the outer ends of said arms support upstanding flexible members 112, the upper ends of which preferably extend slightly above the feed paths defined by the upper surfaces of the bottom feed rollers 74. Accordingly, when the leading end of a cant, while moving in the direction of the arrows 94, engages the upper ends of the flexible members 112, the arms 110 are depressed to slightly move the shafts 106 rotatably and, as shown in FIG. 3, this will result in an arm 114, which is fixed at one end to the shaft 106, being depressed to activate a micro switch 116. Said micro switch is associated with a fluid-control valve 118 from which fluid conduits 119 extend to control the flow of fluid to the hydraulic cylinders 90, and thereby activate the same in a direction to produce pressure upon the upper surface of a cant. When a cant has passed entirely over the flexible members 112, the compression springs 120 associated with the control valves 118 will restore the members 112 to upstanding position to be intercepted by the next oncoming cant, and the valves 118 will be closed. Referring to FIG. 1, it will be seen that the valves 118 respectively are at opposite sides of the outer sides of the saw system illustrated therein.

FEED MECHANISM

Figure 5:
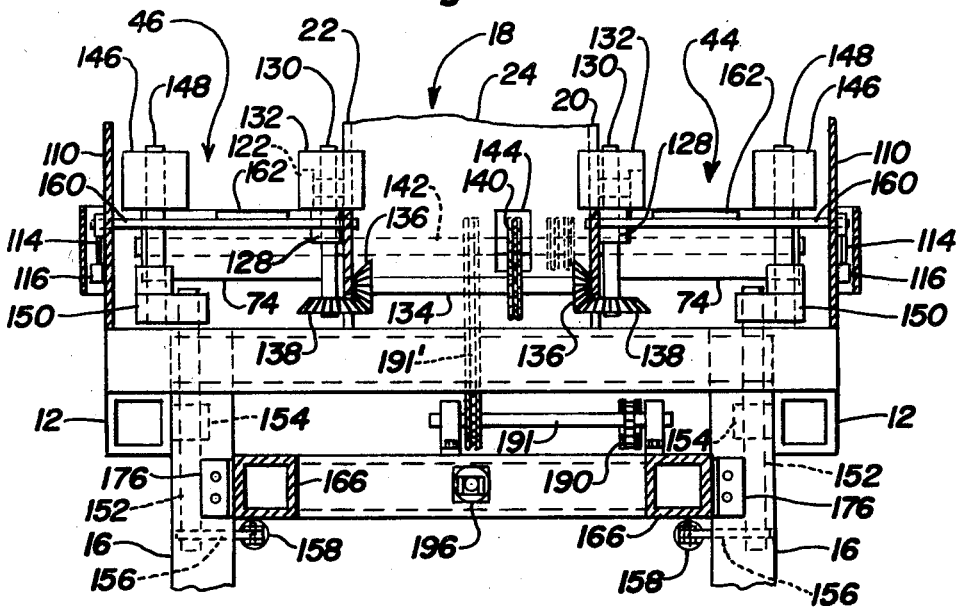
FIG. 5 is a fragmentary vertical sectional view of the receiving end of the saw system as seen on the line 5—5 of FIG. 2.

Referring to FIG. 1, in view of the fact that the present invention comprises a double bay industrial system, said pair of feed paths 44 and 46 are shown in FIG. 1. The inner edges of said paths are defined by longitudinally extending fence plates 122, which are shown to better advantage in FIG. 2, in which it will be seen that said members are discontinued in the region of the lower saw system 32. One of said fence members 122 also is illustrated in phantom in FIG. 4 and an end view of one of the same is shown in FIG. 9. By means of appropriate spacing sleeves 124, shown in FIG. 9, the fence plates respectively are secured to the outer surfaces of side members 20 and 22, in somewhat spaced relationship thereto for purposes of providing space within which the crank arms 82 may function relative to the upper pressure rollers 84. Bolts 126 or the like, shown in FIG. 9, securely connect the fence plates 122 to the opposite side members 20 and 22 for purposes of defining one side of the feed paths 44 and 46. For purposes of introducing in a positive manner, the leading end of cants respectively to said feed paths 44 and 46, attention is directed particularly to FIG. 5, as well as to the right-hand ends of FIGS. 1 and 2, in which the details of such positive feeding mechanism are set forth, as follows:

Fixedly supported adjacent the receiving end of the feed paths 44 and 46, which is the end adjacent the right-hand end of the illustration in FIGS. 1 and 2, are a pair of bearings 128 within which vertical shafts 130 are rotatably supported, the upper ends of which have vertical feed rollers 132 connected thereto, and the outer surfaces thereof farthest from the central axis of the housing 18, are substantially in alignment with the outer faces of the fence plates 122, as can be seen in FIG. 5.

The feed rollers 132 are respectively driven in opposite rotary directions, said directions being such that the surfaces thereof within the planes of the outer faces of fence plates 122 move in feed direction with respect to the feed paths 44 and 46.

The drive for the feed rollers 132 comprises a transverse shaft 134, the outer ends of which are supported within appropriate bearings in the side members 20 and 22, as shown in FIG. 5, and adjacent said opposite ends of the shaft 134, similar bevel gears 136 are fixed for purposes of meshing with mating bevel gears 138 on the lower ends of shafts 130. Shaft 134 is driven by sprocket chain 140, which extends around an appropriate sprocket gear on shaft 134 and extends to and also around another sprocket gear on shaft 142, shown in FIGS. 1 and 2, which is the shaft upon which the lower feed rollers 74 nearest the receiving end of the saw system, are mounted. Referring to FIG. 5, the chain 140 extends through an opening 144 in the end cover plate 24, at one end of the housing 18. Accordingly, in view of the fact that the lower feed rollers 74 are constantly rotated, said vertical feed rollers 132, likewise, will be constantly rotated when the machine is operating.

Cooperating with the feed rollers 132 are pressure rollers 146, which are rotatable as idlers about the upper ends of vertical shafts 148, which extend upward from the outer ends of supporting arms 150, which are connected to the upper ends of vertical shafts 152 that are supported in bearings 154 connected to the side members 12 of the frame of the machine. Affixed at one end to the lower ends of the shafts 152, are crank arms 156, the outer ends of which are connected to the outer ends of piston rods of the fluid-operated cylinder units 158, which preferably are hydraulically-operated.

The feed of fluid to the cylinder units 158 is effected by control means comprising horizontal shafts 160, which are supported at the opposite ends by suitable bearings in the side members 20 and 22, as well as the outer plates 108, as best shown near the right-hand end of FIG. 1. Upstanding from the shafts 160 intermediately of the ends thereof are additional flexible members 162, which are similar to members 112, described hereinabove, and correspond in function thereto, whereby when the same are engaged by the leading ends of cants delivered to the saw system shown in FIGS. 1 and 2, arms 114 on the outer ends of said shafts 160, will activate additional micro switches 116, which are associated with hydraulic valves 118 connected by other fluid conduits 120, see FIG. 3, by which the hydraulic cylinders 158 are actuated to move the pressure rollers 146 toward the respective feed rollers 132, and thereby force the cants into engagement with said feed rollers 132 and, after the cants have completely passed over the flexible control members 162, the springs 120, see FIG. 3, associated with the arms 114, will restore the micro switch to original condition in which the hydraulic valves 118 are closed and the pressure rollers 146 are relaxed from pressure position until the next oncoming cant is to be engaged thereby.

Figure 7:
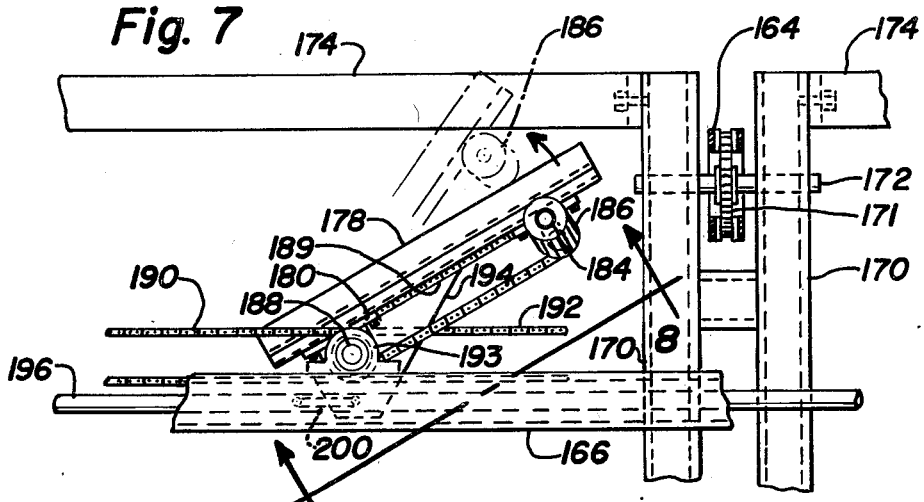
FIG. 7 is a fragmentary side elevation, partly in section, illustrating on a larger scale, details of one of the arm frames and feed rollers of the feeding mechanism, as seen on the line 7—7 of FIG. 6.
Figure 8:
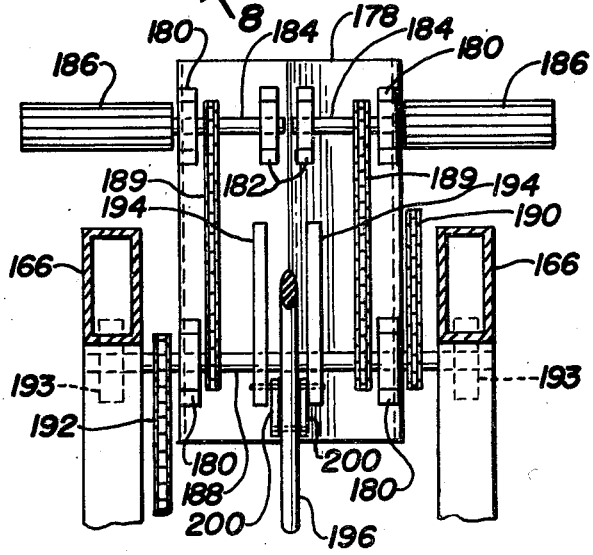
FIG. 8 is a bottom plan view of the arm frame and feed rollers shown in FIG. 8, partly fragmentary and in section, as seen on the line 8—8 of FIG. 7.

Timbers and cants are fed to the receiving end of the saw system and are engaged by the feed rollers 132 and pressure rollers 146 by means of mechanism illustrated specifically in FIGS. 6–8, wherein a series of parallel conveyor chains 164 are shown fragmentarily, it being understood that the fragmentary ends thereof project laterally from the axis of the longitudinal frame comprising a pair of base beams 166 any desired distance for purposes of the upper spans of said conveyor chains receiving and supporting, as well as moving, incoming cants 168, which are illustrated in exemplary manner in FIG. 6, and in no way are intended to illustrate any specific size of cant or timber. Also, said cants or timbers may be of varying lengths and the principal purpose of the feed mechanism illustrated in FIGS. 6–8, is to control the delivery of the cants respectively and selectively to either the feed path 44 or 46.

Also, associated with the base frame comprising the low longitudinally extending base members 166 and projecting upwardly therefrom, are vertical frame members 170, shown in FIGS. 6 and 7, which not only suitably support shafts 172 upon which the sprocket gears 171 are mounted and around which one end of the conveyors 164 extend. Extending between the upper ends of pairs of the vertical frame members 170 are horizontally extending longitudinal stop members 174 of an elongated nature, which extend slightly above the upper span of the conveyor chains 164, as can be seen from FIG. 7.

One end of the lower base frame comprising frame members 166 is connected to the delivery end of the saw system shown in FIGS. 1 and 2. As will be seen from the right-hand end of FIGS. 1 and 2, the beams 166 extend to the front legs 16 of the main frame of the machine and respectively are connected thereto by brackets 176, shown in FIG. 5. Said low base frame extends axially outward from the longitudinal axis of the saw system shown in FIGS. 1 and 2, and is parallel to the feed paths 44 and 46 but in a plane below the plane of said feed paths, as readily can be seen from FIG. 2. At desired longitudinally spaced locations along the low base frame, the same supports a plurality of arm frames 178, which are formed from metal and preferably are channel-shaped. Supported on the outer surface of the channel, adjacent opposite ends thereof, are a plurality of similar bearings 180 and additional bearings 182 are mounted substantially centrally of said outer surface of the channel member 178 in axial alignment with the uppermost bearings 180 for purposes of supporting therebetween end portions of a pair of shafts 184, which project beyond the outer surfaces of the flanges of the frames 178, for purposes of supporting ridged frictional type feed rollers 186. As best shown in FIGS. 6 and 7, the shafts 184 are not coaxial and respectively extend from the opposite sides of the arm frames 178 at angles which are very acute with respect to an axis transverse to the base frame members 166, for purposes to be described.

It also will be seen that the lower ends of the arm frames 178, as viewed in FIG. 7, are provided with an additional shaft 188, which is supported by and extends through, and also projects at opposite ends beyond the bearings 180 at said lower end of the member 178, as readily can be seen in FIG. 8. FIG. 8 also shows that shaft 188 adjacent the inner faces of the bearings 180 has sprocket gears around which sprocket chains 189 extend, said chains also extending around similar sprocket gears fixed to the upper shafts 184. Shaft 188 is both a drive shaft and a driven shaft in view of the fact that the same has additional sprocket gears fixed thereto on opposite end portions which extend beyond the sides of arm frames 178 for purposes of receiving therearound sprocket chains 190 and 192, whereby the chains 190 and 192, which are respectively on opposite sides of the successive arm frames 178, as shown in FIG. 6, comprise successive drive means for the next arm frame, the chain 190 nearest the receiving end of the saw system extending into the lower portion of said inlet end of the system, as seen in FIGS. 1 and 2, the innermost end of the chain 190 extending around a sprocket gear on a shaft 191. Said shaft is driven by another sprocket chain 190' which extends substantially vertically, as seen in FIG. 2, between sprocket gears on shaft 142 and shaft 191. It will be seen that the feed rollers 186 are continuously driven when the machine is in operation, in the same manner as the bottom feed rollers 74 are continuously driven, as described above.

The arm frames 178 are pivotally supported by the shafts 188 at the lower ends thereof, the outer ends of which shafts are supported in bearings 193, shown in FIG. 7, which respectively are connected to the upper surfaces of the base beams 166. As shown also in FIGS. 7 and 8, plate members 194, which, as seen in FIG. 7, are somewhat trapezoidal in shape, function as crank arms, and the same are transversely spaced as viewed in FIG. 8, for purposes of receiving therebetween an actuating rod 196, which is elongated and, as shown in FIG. 6, extends between all of the lower ends of the arm frames 178, the end thereof which is nearest the saw system being connected to a fluid-operated cylinder unit 198, which, as shown in FIGS. 1, 2 and 5, is in the lower portion of the receiving end of the saw system shown in said figures.

Reciprocation of the rod 196 at opposite directions by the cylinder unit 198 results in simultaneous pivotal movement of all of the arm frames 178 by virtue of the lower ends of the crank arm plates 194 being connected by pairs of links 200, shown best in FIGS. 7 and 8, to longitudinally spaced locations along the rod 196. The purpose of such movement of the arm frames 178 is as follows:

When it is desired to feed a cant from a suitable delivery means onto the conveyor chain 164, an operator manually manipulates a control valve for delivering fluid, preferably hydraulic fluid, to the required end of the cylinder unit 198, for purposes of either raising or lowering the upper ends of the arm frames 178. When in the elevated position, which is shown in phantom in FIG. 7, it will be seen that the outermost end of the arm frames 178 project in front of the stop members 174. Accordingly, if it is desired to deliver the selected cant to the so-called near feed path 46 of the saw system, shown in FIGS. 1 and 2, the arm frames 178 will intercept the delivery movement of the cant and, in view of the fact that the feed rollers 186 on said arm frames are all continuously revolving in feeding direction, the rollers on the near side of the arm frames 178, which are those which are lowermost, as viewed in FIG. 6, will feed the cant to the near feed path 46, as shown diagrammatically at the left-hand end of FIG. 6. However, if it is desired to feed the cant to the farthest feed path 44, as the cant is moved by the conveyor chains 164 toward the stop members 174, the arm frames 178 remain in the full line position, for example, shown in FIG. 7, whereupon the cants may be advanced by the chains 164 until they abut the stop members 174, whereby the cants will be axially aligned with the farthest feed path 44 and then the operator will elevate the arm frames 178 to dispose the far feed rollers 186, which are those nearest the stop members 174, as viewed in FIG. 6, and the rotation of the feed rollers 186, which have been elevated to engage the lower surface of the cant will feed the same to the far feed path 44.

Further to position the cants accurately upon the desired feed paths, the angular disposition of the feed rollers 186, described above, causes the cant to be urged toward the fence plates 122, which facilitates the function of the pressure rollers 146 that cooperate with the feed rollers 132 at the receiving end of the saw system, which further insure the accurate positioning of the cants upon their respective feed paths 44 and 46.

In the preferred operation of the sawing system of the present invention, it is desired that all the fluid-operated cylinder units and fluid-operated motors are operated by pump means driven, preferably, by a single source of power such as a diesel engine of relatively high horsepower rating, and thereby simplify the furnishing of power to all parts of the sawing and feeding implements of the system, except the electric motors 60 and 62, which are preferred for purposes of driving the saw units per se on the arbors 34 and 36.

The foregoing description illustrates preferred embodiments of the invention. However, concepts employed may, based upon such description, be employed in other embodiments without departing from the scope of the invention. Accordingly, the following claims are intended to protect the invention broadly, as well as in the specific forms shown herein.

I claim:

1. A double bay industrial saw system operable to receive timber cants and selectively direct the same respectively to one or the other bays of said saw system and comprising in combination:

(a) a longitudinal frame, the opposite ends of which comprise a receiving end and a discharge end and feed paths within a common plane extending along opposite sides of said frame, (b) cant-receiving means extending longitudinally outward from said receiving end of said frame within a common horizontal plane respectively aligned with, (c) cant-delivery means comprising conveyor means operable transversely from one side of said receiving means and operable to feed cants to said receiving means in sequence, (d) control means operable to dispose said cants selectively in longitudinal alignment with said feed paths along said frame, (e) a longitudinal housing extending along said frame centrally thereof between said feed paths, (f) a pair of saw arbors having opposite ends projecting horizontally from opposite sides of said housing in longitudinally and vertically spaced relationship relative to each other and each pair of ends thereof respectively adapted to have one or more cooperating sets of saws mounted thereon for coaction to make complete cuts through said cants by the respective saws of each set forming parts of a common through cut extending from the bottom and top of said cants, (g) a plurality of shafts extending through said housing and having ends underlying said feed paths and supporting similar feed rolls of which the upper surfaces define said paths, (h) sub-frames within said housing respectively supporting short shafts respectively and independently extending oppositely therefrom and extending horizontally through openings in the sides of said housing, (i) arms extending transversely from the outer ends of said shafts and supporting horizontal pressure rollers on the outer ends of said arms, (j) power means operable to urge said shafts independently in directions to move said pressure rollers toward said feed rollers and engage the upper surfaces of cants moved by said feed rollers toward, past and from said sets of saws when mounted on said arbors, (k) control means activated by advancing cants to energize said power means to urge said pressure rollers as aforesaid, and (l) master power means connected to said shafts supporting said feed rollers and operable to drive all of said shafts and feed rollers simultaneously and continuously while said system is in operation.

2. The saw system according to claim 1 in which said short shafts are supported in bearings within said sides of said housing, and fence plates extend along the sides of said housing adjacent said feed paths to space the sides of cants from the sides of said housing and thereby clear said bearings from contact by said cants.

3. The saw system according to claim 1 further including additional pairs of feed and pressure rollers operable upon vertical shafts spaced transversely, each pair respectively being mounted adjacent the end of said housing nearest said cant delivery means upon said frame, the feed roller and its shaft of each pair being mounted respectively adjacent the opposite sides of said housing and the pressure roller of each pair having its shaft supported adjacent the outer sides of said feed paths for movement toward and from the feed roller of said pair, power means operable to move said pressure rollers and their shafts toward said drive rollers, and drive means for said feed rollers commonly connected to the shafts thereof for unitary drive of said feed rollers.

4. The saw system according to claim 3 in which said drive means for said feed rollers comprise a transverse shaft positioned between the lower ends of the shafts of said feed rollers, and pairs of mating bevel gears respectively being mounted on the lower ends of the feed roller shafts and opposite ends of said transverse shaft.

5. The saw system according to claim 1 in which said pressure rollers which are supported by opposite sides of said housing are arranged in sets respectively supported in opposite end portions of said housing, and said sets further including crank arms mounted upon said short shafts within said housing, said power means comprising fluid-operated cylinder and piston units supported within said housing and connected to the outer ends of said crank arms, and means connecting said units to a source of fluid under pressure delivered to said units, said delivery being ordered by said control means.

6. The saw system according to claim 5 in which said sets of pressure rollers at opposite sides of said housing are arranged in pairs supported upon corresponding pairs of said short shafts and crank arms thereon respectively spaced longitudinally along said feed paths, one of said crank arms of each pair being urged by spring means in a direction to move the roller interconnected thereto downward for pressure against the upper surface of a cant.

7. The saw system according to claim 6 in which the spring means by which said one of each pair of pressure rollers is urged is a compression spring mounted upon a rod, an additional crank arm mounted upon each of the short shafts of each pair thereof and extending downward therefrom, means connecting one end of said rod to the additional crank arm which is connected to said fluid cylinder unit, means slidably supporting the other end of said rod in the lower end of the other additional crank arm, and a fixed abutment midway of said rod compressing said spring between it and said other crank arm.

8. The saw system according to claim 5 in which said control means for said pressure rollers supported by said housing comprise arms movably mounted upon said frame below said feed paths and having ends projecting into said feed paths for engagement by the leading ends of oncoming cants, and a mico switch supported by said frame adjacent each arm and operable when engaged by a cant to activate said switch in a manner to energize the fluid-operated unit controlled thereby to move the pressure roller associated therewith downward.

9. The saw system according to claim 1 in which said cant-receiving means comprises:

(a) low horizontal frame means extending longitudinally outward from the receiving end of said longitudinal frame, (b) a plurality of conveyor chains extending laterally outward from said low frame and at least the ends of said chains nearest said low frame being at a level above said frame, (c) said control means comprising a plurality of arm frames pivotally supported at one end by said low frame at longitudinally-spaced locations therealong within a vertical plane between said feed paths, (d) pairs of feed rollers rotatably mounted respectively on opposite sides of the outer ends of said arm frames, (e) longitudinal stop means supported in alignment with the outer edge of the feed path farthest from said conveyor means relative to the direction of feed thereby, (f) power means operable to rotate said feed rollers on said arm frames commonly in a direction to feed cants toward the receiving end of said longitudinal frame, (g) additional power means operable to raise said arm frames and feed rollers thereon simultaneously to a level above said conveyors and intercept cants upon said conveyor chains for delivery by said feed rollers to the nearest feed path, and (h) control means for said additional power means operable to raise said arm frames and feed rollers only after a cant has engaged said stop means and then feed said cant to the farthest feed path of said system.

10. The saw system according to claim 9 in which said power means to rotate said feed rollers comprise chains extending around sprocket gears driven by additional chains and gears interconnected to effect a common drive system.

11. The saw system according to claim 9 in which the drive rollers at opposite sides of the outer ends of said arm frames respectively are on axes at opposite sharp angles to an axis transverse to the feed paths for said cants, said angles extending in a direction to urge said cants as propelled by said feed rollers toward the sides of said housing along which said feed paths extend.

12. The saw system according to claim 9 in which said additional power means to raise said arm frames comprise a fluid-operated cylinder unit having an elongated piston rod extending along said low horizontal frame, a crank arm extending from the pivoted end of each arm frame, and link means extending between the outer ends of each crank arm and said piston rod for simultaneous corresponding movement of said arm frames in opposite directions.

* * * * *